United States Patent [19]

Steiner et al.

[11] 4,385,550

[45] May 31, 1983

[54] WHOLE HOUSE FAN

[75] Inventors: Robert E. Steiner; Chandrakant V. Savla, both of St. Louis County, Mo.

[73] Assignee: Emerson Electric Co., St. Louis, Mo.

[21] Appl. No.: 248,021

[22] Filed: Mar. 26, 1981

[51] Int. Cl.[3] ..... F24F 7/06; F24F 13/08

[52] U.S. Cl. ..... 98/43 R; 174/48; 248/343

[58] Field of Search ..... 98/43 R, 39, 116, 40 D, 98/40 DL; 52/199; 248/342, 343; 361/384; 174/48; 417/360, 361; 403/346, 347

[56] References Cited

U.S. PATENT DOCUMENTS

| | | | |
|---|---|---|---|
| 1,690,941 | 11/1928 | Nickerson | 248/343 X |
| 1,693,396 | 11/1928 | Littleton | 248/343 |
| 2,673,514 | 3/1954 | Hanks | 98/116 |
| 2,911,900 | 11/1959 | Rudy | 98/116 |
| 3,149,553 | 9/1964 | Solzman | 98/43 R |
| 3,315,924 | 4/1967 | Greenwood | 248/342 X |
| 3,895,568 | 7/1975 | Stone | 98/43 R |
| 4,123,968 | 11/1978 | Malott | 98/43 R |
| 4,271,751 | 6/1981 | Timmons | 98/40 D |

FOREIGN PATENT DOCUMENTS

| | | | |
|---|---|---|---|
| 819012 | 8/1959 | United Kingdom | 98/43 R |

*Primary Examiner*—William E. Tapolcai

*Attorney, Agent, or Firm*—Polster, Polster and Lucchesi

[57] ABSTRACT

A whole house ventillator which can be installed without framing and cutting joists. Struts below the fan blade serve as a support for a fan motor and for a venturi. Adjustable pre-cut sleeving fits over the joists and around the fan to eliminate framing. A shutter assembly may be surface-mounted to the ceiling below the joists.

15 Claims, 8 Drawing Figures

WHOLE HOUSE FAN

BACKGROUND OF THE INVENTION

This invention relates to a whole-house fan and in particular to a whole-house fan which is easier to install than those presently known.

A whole-house fan typically includes a fan assembly framed into the floor joists of an attic area and a shutter assembly secured to the fan assembly through an opening in the ceiling of the living-area below the fan assembly. The fan assembly includes a sheet metal venturi having a peripheral depending skirt and a central opening or throat. Brackets mounted on the venturi support a fan impeller in the venturi throat. The impeller is driven by an electric motor which is typically mounted either coaxially above the impeller for directly driving the impeller, or on a corner of the venturi for a belt drive. Whole-house fans are sometimes also mounted vertically on a gable or other wall.

Whole-house fans effectively prevent the build-up of heat in the building interior and attic, with a minimum of energy consumption. Their expanded use, however, has been hindered because the fan assemblies are difficult to install. To create the required opening between the living-area and the attic, a hole is cut in the living-area ceiling. The impeller diameter is typically on the order of 2 feet to 3 feet, the opening is typically from 2 feet to 4 feet square, and ceiling joists are typically 16 inches or 24 inches on center. Therefore, one or more joists must be cut. A frame is then built by nailing headers to the ends of the cut joists. In unfinished attics, a platform is laid over the joists to support the fan. The fan assembly is then mounted to the platform, and the shutter assembly is mounted to the ceiling.

SUMMARY OF THE INVENTION

One of the objects of this invention is to provide a whole-house fan which is easier to install in a ceiling than presently existing fans.

Another object is to provide such a fan which is simple and relatively inexpensive to manufacture.

Other objects will occur to those skilled in the art in light of the following description and accompanying drawings.

In accordance with one aspect of this invention, generally stated, a whole-house fan assembly is provided which includes a venturi for defining an air path, the venturi having an opening defining a throat, an impeller for drawing air through the venturi throat, and a motor for driving the impeller, characterized in that the venturi includes a depending skirt having means in it for accommodating joists to permit the skirt to fit over at least one joist and into close propinquity with the ceiling. Preferably, the skirt is made of corrugated sheet material, and includes a plurality of pre-scored tabs for accommodating differently spaced joists and joists of different heights.

In accordance with another aspect of the invention, a frame is provided which supports the impeller, the motor and the venturi, and which includes mounting means for mounting the frame to the upper faces of joists. Preferably, the frame includes a pair of spaced-apart U-brackets, the housing is attached to up-turned arms of the U-brackets and the impeller motor is attached by a mounting plate to horizontal reaches of the U-brackets.

In accordance with another aspect of the invention, a whole-house fan assembly is provided which includes a venturi for defining an air path, the venturi having an opening defining a throat, a fan for drawing air through the venturi throat, and a motor for driving the fan, characterized in that the motor is mounted coaxially with and below the fan.

Preferably, the venturi includes a sheet metal fan housing part and a separate skirt formed of one or more panels.

Other aspects of the invention will be better understood in light of the following description of the preferred embodiment.

DESCRIPTION OF THE PREFERRED EMBODIMENT

Figure 1:
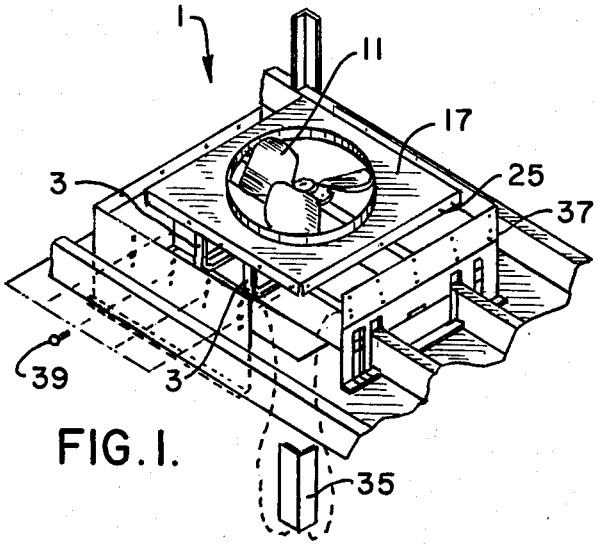
FIG. 1 is an exploded view in perspective of one illustrative embodiment of whole-house fan of the present invention mounted in an ceiling structure.

Referring now to the drawings, reference numeral 1 indicates a whole-house fan assembly of the present invention. The fan assembly 1 includes a pair of parallel U-shaped brackets 3, a fan mounting bracket 5 welded to the horizontal reaches of the U-shaped brackets 3, a fan motor 7 extending through a central opening 9 in the fan mounting bracket 5, a three-bladed fan impeller 11 mounted on the upwardly extending shaft 13 of the motor 7, and a venturi 15 including a sheet metal fan housing 17 and a peripheral depending skirt 19.

Each of the U-shaped brackets 3 includes a horizontal reach 21 having pre-drilled holes 20 spaced sixteen inches apart and twenty-four inches apart for mounting the fan assembly 1 on joists 22. In the illustrative embodiment, the joists 22 are two-by-six boards spaced on sixteen inch centers. The upper ends of vertical arms 23 of the U-shaped brackets 3 are welded to a down-turned peripheral flange 25 of the fan housing 17. The fan housing 17 further includes a conventional central throat 27 in which the fan impeller 11 is mounted.

Ears 29 are welded to the fan motor 7 for mounting the motor 7 to the bracket 5 by means of bolts 31 and rubber vibration-damping grommets 33.

Figure 7:
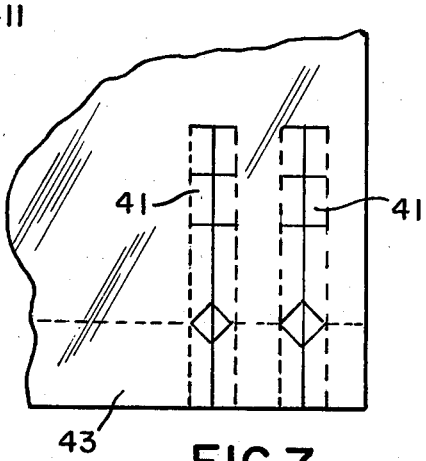
FIG. 7 is a detail of a skirt part of the fan of FIGS. 1 and 2.
Figure 3:
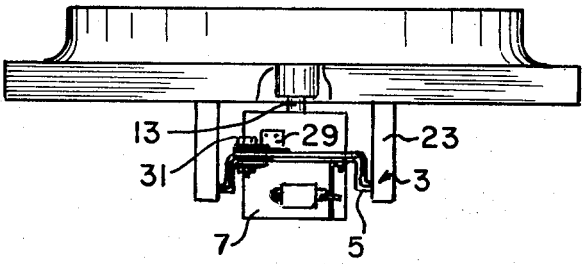
FIG. 3 is a view in side elevation of the fan of FIGS. 1 and 2.

The skirt 19 is formed of two identical sheets of corrugated board, preferably polypropylene. The two pieces forming the skirt 19 are held to each other by corner brackets 35 into which the free ends of the skirt 19 are pressed during installation of the fan assembly 1. All four walls of the skirt 19 include pre-scored holes 37 for securing the skirt 19 to the flange 25 of the fan housing 17. Three sets of holes, spaced two inches apart vertically, are provided on all four walls of the skirt 19, to accommodate joists 22 which are nominally four, six or eight inches tall. Two opposing walls of the skirt 19 further include pre-scored tabs 41 for accommodating joists on different spacings and of different heights. FIG. 7 shows details of the tabs 41, with pre-scored cutting lines shown as solid lines and pre-scored bending lines shown as dotted lines. It will be seen that the tabs 41 are bent out along the joists 22 and facilitate taping the openings around the joist if desired. Likewise, a flap 43 is bent out at the bottom of the skirt 19 to form a tight fit with the upper face of the ceiling 45.

Figure 4:
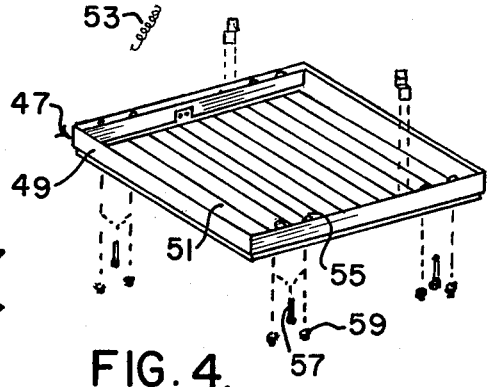
FIG. 4 is an exploded view in perspective of a shutter assembly for use with the fan of FIGS. 1–3.
Figure 5:
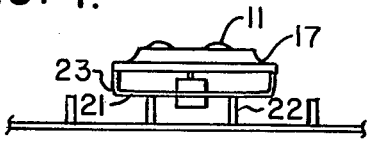
FIG. 5 is a somewhat diagrammatic view in end elevation of the fan of FIGS. 1–3, partially installed in a ceiling.
Figure 6:
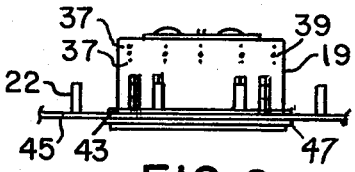
FIG. 6 is a somewhat diagrammatic view in end elevation of the fan and shutter assembly of FIGS. 1–4, corresponding to FIG. 5, showing the fan and shutter assembly installed in a ceiling.
Figure 2:
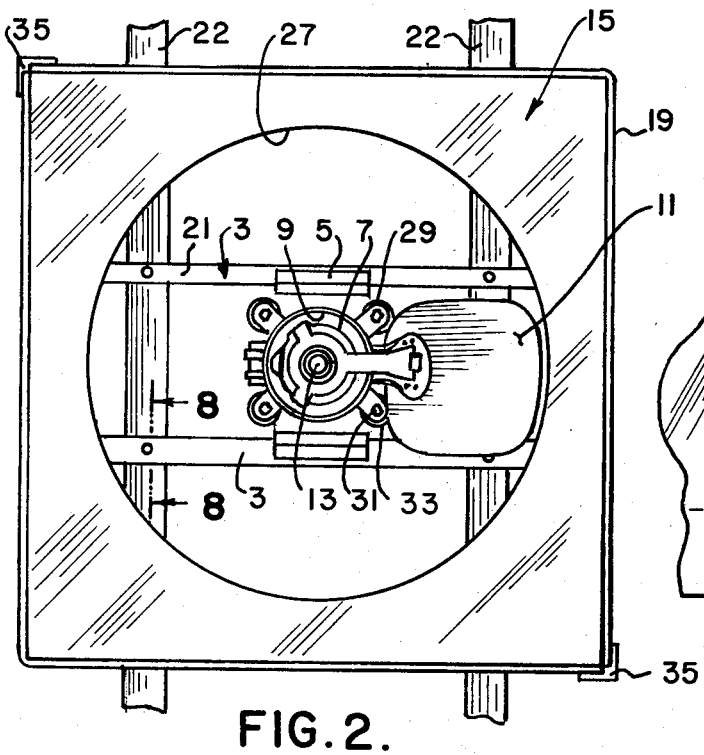
FIG. 2 is a top plan view, partially cut away, of the fan of FIG. 1.

Referring now to FIG. 4, the shutter assembly 47 includes a frame 49 carrying a plurality of shutters 51 which are conventionally connected to each other for simultaneous movement. A spring 53 biases the shutters closed. The frame 49 includes openings 55 for wood screws 57. The openings 55 are spaced sixteen inches and twenty-four inches apart, for surface mounting the shutter assembly 47 to the underside of ceiling 45 and securing it to the joists 22. Plugs 59 are provided for all eight openings 55, to provide a finished appearance for the frame 49.

Figure 8:
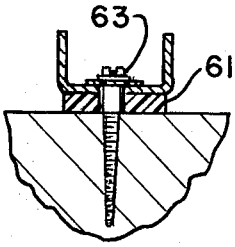
FIG. 8 is a partial sectional view taken along the line 8—8 of FIG. 2.

The assembly of the fan 1 and shutter assembly 47 to a ceiling, without cutting joists, is accomplished as follows. A suitable place is chosen in accordance with established criteria. If the place selected is a hallway, the joists must run perpendicular to the hallway. Any obstructions such as pipes or wires in the attic are removed. A hole is drilled from below in the center of the desired location, and a wire is passed through the hole to mark the spot. Using the wire as a transverse center line, the point half way between joists is found and a second hole is drilled from above. Using the second hole as the center, an opening is cut in the ceiling to fit the fan assembly 1. Rubber grommets 61 are forced into the appropriate holes 20 in the U-shaped brackets 3 for the spacing of joists 22. The fan assembly 1 is lifted through the ceiling hole and placed on the joists 22, centered on the ceiling opening. Electrical connections are made to the fan motor. The skirt 19 is assembled with clips 35, the appropriate tabs 41 are bent out for the spacing and height of the joists 22, and the skirt is attached to the housing 17 by fasteners 39. The assembly is then secured to the joists by screws 63 extending through the grommets 61, as shown in FIG. 8. It will be seen that when the fan assembly 1 is installed, the motor 7 extends below and between the joists 22. If desired, the joint between the skirt and the ceiling and joists may be taped or caulked to reduce air leakage.

The spring 53 on the shutter assembly 47 is stretched between brackets on the frame 49 and on the shutters 51 to an adjustment at which the spring 53 just closes the shutters 51. The shutter assembly is then secured to the joists 22 by screws 57. The shutters 51 are mounted in the frame 49 in such a manner as to clear the bottoms of the joists 22 when the shutters are open. The shutters are balanced to be pulled open by the draft of the fan, but to close when the fan is not running, as is conventional.

Numerous variations in the whole-house fan of the present invention, within the scope of the appended claims, will occur to those skilled in the art in light of the foregoing disclosure. Merely by way of example, the preferred fan assembly may be mounted vertically to an exterior wall, without cutting the wall studs, by mounting the fan assembly with the support brackets to the inside of the attic and using four mounting brackets extending from the studs to and around the flange 25 of the fan housing 17 to hold the fan housing the proper distance from the wall. The skirt 19 is then attached to the flange 25, between the fan housing and the wall, and the tabs 41 are bent around the studs. Exterior shutters are then attached to the exterior of the wall. Likewise, the fan assembly 1 may be mounted on a ceiling or wall by cutting joists or studs and building a frame in the conventional manner, to permit the shutters to be recessed flush into the ceiling or wall. Preferably, a pair of two-by-six supports are notched and mounted in the frame, so that the fan assembly is mounted to the supports and the bottom of the skirt is sealed to the top of the frame. These variations are merely illustrative.

What is claimed is:

1. A whole-house fan assembly for installation over joists in an opening in a ceiling, said assembly comprising (a) a venturi for defining an air path through said assembly, said venturi including an opening defining a throat, (b) a fan impeller for forcing air through said venturi throat, and (c) a motor for driving said fan impeller, characterized in that said venturi includes a depending skirt having means therein for accommodating joists to permit said skirt to fit over at least one of said joists and into close propinquity to said ceiling, said means for accommodating joists comprising openings in two opposed sides of said skirt, said openings in said skirt each having a height substantially equal to the height of said joists.

2. The fan assembly of claim 3 wherein said skirt includes a plurality of tabs for accommodating differently spaced joists.

3. A whole-house fan assembly for installation over joists in an opening in a ceiling, said assembly comprising (a) a venturi for defining an air path through said assembly, said venturi including an opening defining a throat, (b) a fan impeller for forcing air through said venturi throat, and (c) a motor for driving said fan impeller, characterized in that said venturi includes a depending skirt having means therein for accommodating joists to permit said skirt to fit over at least one of said joists and into close propinquity to said ceiling said means for accommodating said joists comprising pre-scored tabs.

4. The fan assembly of claim 3 wherein said tabs are scored to different heights, to accommodate joists of differing heights.

5. A whole-house fan assembly for installation over joists in an opening in a ceiling, said assembly comprising (a) a venturi for defining an air path through said assembly, said venturi including an opening defining a throat, (b) a fan impeller for forcing air through said venturi throat, and (c) a motor for driving said fan impeller, characterized by frame means for supporting said venturi, said fan impeller and said motor, and mounting means for mounting said frame means to the upper surfaces of said joists, said frame means comprising a pair of spaced-apart frame members, each of said frame members including a horizontal reach, said venturi further comprising a depending skirt extending a distance below said horizontal reaches of said frame members substantially equal to the height of said joists.

6. The fan assembly of claim 5 wherein said fan impeller is rotatable about a vertical axis and wherein said motor is mounted coaxially with and below said fan impeller.

7. The fan assembly of claim 6 wherein each of said frame members is U-shaped, said venturi being secured to up-turned arms of said members, and said motor and said fan being supported by horizontal reaches of said members, said skirt being adjustable with respect to said up-turned arms and with respect to said throat to accommodate joists of different heights without changing the relationship between said impeller and said throat.

8. A whole-house fan assembly for installation over joists in an opening in a ceiling, said assembly comprising (a) a venturi for defining an air path through said assembly, said venturi comprising a fan housing including an opening defining a throat, (b) a fan impeller for forcing air through said venturi throat, and (c) a motor for driving said fan impeller, characterized by frame means for supporting said fan impeller and said motor, and comprising a pair of spaced-apart frame members for mounting said fan impeller and said motor on the upper surfaces of said joists, each of said frame members including a horizontal reach, said housing including a depending skirt extending a distance below said horizontal reaches of said frame members substantially equal to the height of said joists.

9. In a fan to be installed in the ceiling of a house or other building for drawing air through the house and for exhausting air into the attic space of the building, said fan comprising an impeller for moving the air, a motor for driving said impeller, said ceiling of said building being constructed in such manner as to have at least two, generally parallel, horizontal joists spaced apart by a predetermined distance, a ceiling secured to the bottom faces of said joists, and an opening in said ceiling, wherein the improvement comprises: a frame securable to the upper surfaces of said joists, said frame carrying said motor and said impeller with said impeller in communication with said opening, a venturi having a throat through which air moved by said impeller is forced, and skirt means extending between said throat and the upper surface of said ceiling panel so as to form an air passageway between said ceiling opening and said throat, said skirt means being formed of sheet material and having four sides, two opposed sides of said skirt means having means preformed thereon for accommodating said at least two joists.

10. A whole-house fan assembly for installation over joists in an opening in a ceiling, said assembly comprising (a) a venturi for defining an air path through said assembly, said venturi comprising a fan housing including an opening defining a throat, (b) a fan impeller for forcing air through said venturi throat, and (c) a motor for driving said fan impeller, characterized by frame means for supporting said fan impeller and said motor, and mounting means for mounting said frame means to the upper surfaces of said joists, said housing including a depending skirt extending a distance below said mounting means substantially equal to the height of said joists.

11. The fan assembly of claim 10 wherein said skirt comprises removable means for permitting said skirt to fit over at least one of said joists.

12. In a whole-house fan installed above an opening in a ceiling, said ceiling being supported by a plurality of generally horizontal, parallel joists above said ceiling, the improvement wherein said fan is installed over a pair of adjacent joists without cutting either of said joists, said fan comprising a fan impeller for drawing air through said opening in said ceiling, said fan impeller having a vertical axis of rotation, said fan impeller including blades which extend over said pair of adjacent joists when said fan is in operation; a motor for driving said fan impeller; a frame for supporting said fan impeller and said motor on said joists; and a venturi for defining an air path through said fan, said venturi including an opening defining a throat and a depending skirt fitting into close propinquity to said ceiling, wherein said opening in said ceiling and said depending skirt extend beyond said pair of adjacent joists, wherein said depending skirt is formed with a plurality of means for accommodating joists of different heights and on different spacings, two pairs of said plurality of means having been utilized to define openings in two opposed sides of said skirt, said openings each having a height substantially equal to the height of said pair of joists, and wherein said frame comprises a pair of spaced apart frame members extending across said pair of joists at right angles thereto, said frame members also including mounting means accommodating joists on different spacings, two pairs of said mounting means having been utilized to mount said fan to the upper faces of said pair of joists.

13. The fan of claim 12 further including a shutter assembly mounted on a lower face of said ceiling.

14. The fan of claim 13 wherein said opening and said shutter assembly both extend below and beyond said pair of adjacent joists, said shutter assembly being surface mounted to said ceiling and including a plurality of shutters constructed and arranged to open below said pair of joists when said fan is operated.

15. The fan of claim 12 wherein said motor extends between and below the upper surfaces of said joists.

* * * * *